US007753447B2

(12) United States Patent
Sulzer

(10) Patent No.: US 7,753,447 B2
(45) Date of Patent: Jul. 13, 2010

(54) CASUAL CONTROL TILT LOCKOUT

(75) Inventor: James H. Sulzer, Goodyear, AZ (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 11/871,733

(22) Filed: Oct. 12, 2007

(65) Prior Publication Data

US 2008/0111414 A1 May 15, 2008

Related U.S. Application Data

(60) Provisional application No. 60/829,488, filed on Oct. 13, 2006.

(51) Int. Cl.
*A47C 3/026* (2006.01)

(52) U.S. Cl. ..... 297/302.1; 297/302.7; 297/325; 297/328

(58) Field of Classification Search ..... 297/325, 297/302.1, 302.5, 302.3, 302.6, 302.7, 328, 297/215, 198; 248/592, 629, 630
See application file for complete search history.

(56) References Cited

U.S. PATENT DOCUMENTS 1,491,918 A * 4/1924 Nolan ..... 297/295
2,353,737 A * 7/1944 Lorenz ..... 297/300.4
2,818,911 A * 1/1958 Syak ..... 248/575
4,099,775 A 7/1978 Mizelle
4,101,167 A 7/1978 Ornberg
4,384,741 A 5/1983 Flum et al.
4,555,085 A 11/1985 Bauer et al.
4,616,877 A 10/1986 Slaats et al.
4,627,662 A 12/1986 Carter et al.
4,664,445 A 5/1987 Groseth
4,709,963 A 12/1987 Uecker et al.
4,711,491 A * 12/1987 Ginat ..... 297/300.5
4,763,950 A 8/1988 Tobler
4,790,595 A * 12/1988 Hensel et al. ..... 297/285
4,911,501 A * 3/1990 Decker et al. ..... 297/300.8
5,007,679 A 4/1991 Mizelle
5,018,787 A 5/1991 Estkowski et al.
5,052,750 A 10/1991 Takahashi et al.
5,267,777 A * 12/1993 Valtri ..... 297/302.1
5,308,028 A 5/1994 Kornberg
5,348,372 A 9/1994 Takamatsu et al.
5,417,474 A 5/1995 Golynsky
5,427,434 A 6/1995 Hybarger
5,464,274 A 11/1995 Golynsky et al.
5,683,139 A 11/1997 Golynsky et al.
5,762,402 A 6/1998 Gillotti
5,765,914 A 6/1998 Britain et al.

(Continued)

FOREIGN PATENT DOCUMENTS

GB 2348125 A 9/2000

*Primary Examiner*—Peter R. Brown
(74) *Attorney, Agent, or Firm*—Conley Rose, P.C.

(57) ABSTRACT

An apparatus comprising a cantilever having a distal end and a proximate end, a frame portion coupled to the distal end, a base portion coupled to the proximate end, and a locking apparatus coupled to the frame portion, the base portion, or the cantilever, wherein the locking apparatus has a locked position and an unlocked position, and wherein the locking apparatus prevents the frame portion from tilting relative to the base portion when the locking apparatus is in the locked position.

9 Claims, 10 Drawing Sheets

U.S. PATENT DOCUMENTS 5,918,935 A * 7/1999 Stulik et al. ..... 297/300.5
5,921,696 A 7/1999 Gillotti
5,997,087 A 12/1999 Stumpf
6,000,756 A 12/1999 Hybarger et al.
6,010,189 A 1/2000 Hybarger et al.
D422,814 S 4/2000 Sulzer
6,131,996 A 10/2000 Gebhard
6,139,103 A 10/2000 Hybarger et al.
6,174,031 B1 1/2001 Lindgren et al.
6,250,715 B1 * 6/2001 Caruso et al. ..... 297/303.1
6,286,900 B1 9/2001 Roark
6,327,982 B1 12/2001 Jackson
6,378,943 B1 4/2002 Beggs et al.
6,450,577 B1 9/2002 Roslund, Jr.
6,467,845 B1 10/2002 Chen
6,511,128 B2 * 1/2003 Piretti ..... 297/300.4
6,513,222 B2 2/2003 Von Ehr et al.
6,619,740 B2 9/2003 Beggs
6,729,688 B2 * 5/2004 Erne ..... 297/302.1
6,783,180 B1 8/2004 Young
7,306,289 B2 * 12/2007 Kobayashi ..... 297/423.12
2004/0104611 A1 * 6/2004 Caruso et al. ..... 297/302.1

* cited by examiner

CASUAL CONTROL TILT LOCKOUT

CROSS-REFERENCE TO RELATED APPLICATIONS

This application claims priority under 35 U.S.C. 119 to U.S. provisional patent application Ser. No. 60/829,488 filed on Oct. 13, 2006 and entitled "Casual Control Tilt Lockout", which is hereby fully incorporated by reference.

STATEMENT REGARDING FEDERALLY SPONSORED RESEARCH OR DEVELOPMENT

Not applicable.

REFERENCE TO A MICROFICHE APPENDIX

Not applicable.

FIELD OF INVENTION

The present invention is directed generally to a locking apparatus for fixing tilt position, and more specifically to a locking apparatus for cantilever-type tilting mechanisms for use generally on casual chairs and related articles of furniture.

BACKGROUND

It is generally desirable for chairs to be able to tilt backwards at a person's discretion. The tilting feature can be achieved using various types of mechanisms including springs, shafts, and gas cylinders; however, a less bulky and complex tilting mechanism is a cantilever. The cantilever is made of a generally rigid material that flexes when a load is applied thereto. The cantilever is attached at one end to the upper portion of the chair and at the other end to the lower portion of the chair and is sufficiently rigid to hold the upper portion of the chair in the generally upright position when the chair is empty or the person is sitting upright in the chair. However, when the person leans back on the upper portion of the chair, the cantilever flexes, thereby allowing the upper portion of the chair to tilt relative to the lower portion of the chair. Cantilevers may be used in any type of chair but are most frequently found on casual, outdoor dining chairs.

Although it is often desirable for a chair to be able to tilt, it is sometimes desirable for the tilting mechanism to be temporarily disabled. For example, when a person is eating at a table, a tilted chair can be informal, distracting, and/or otherwise undesirable. Thus, it is advantageous to have a tilt lockout on the chair so that the tilting feature can be activated and deactivated at the person's discretion. A reliable apparatus for locking out the tilting mechanism for a cantilever tilting mechanism, preventing a chair with a cantilever-type tilting mechanism from tilting rearward, is therefore disclosed.

SUMMARY

In one aspect, the disclosure includes an apparatus comprising a cantilever having a distal end and a proximate end, a frame portion coupled to the distal end, a base portion coupled to the proximate end, and a locking apparatus coupled to the frame portion, the base portion, or the cantilever, wherein the locking apparatus has a locked position and an unlocked position, and wherein the locking apparatus restricts tilting of the frame portion relative to the base portion when the locking apparatus is in the locked position. In the locked position, the locking apparatus may support the distal end of the cantilever, restricting downward flexing of the cantilever. In an embodiment, the locking apparatus includes a block, and the block in its locked position contacts both the cantilever and the base portion.

In another aspect, the disclosure includes an article of furniture comprising a base portion, a frame portion coupled to the base portion such that the frame portion tilts relative to the base portion, and a locking apparatus having a locked position and an unlocked position, wherein the locking apparatus lodges between the frame portion and the base portion when the locking apparatus is in the locked position, thereby preventing the frame portion from tilting relative to the base portion, and wherein the frame portion tilts relative to the base portion when the locking apparatus is in the unlocked position.

In a third aspect, the disclosure includes a chair comprising a base, a tilter coupled to the base such that the tilter rotates relative to the base, a cantilever having a proximate end coupled to the tilter and a distal end, a frame coupled to the distal end, the frame supporting a seat, and a locking apparatus having a locked position and an unlocked position and coupled to the tilter, the cantilever, or the frame.

BRIEF DESCRIPTION OF THE DRAWINGS

For a more complete understanding of the present disclosure, and for further details and advantages thereof, reference is now made to the accompanying drawings, in which.

DETAILED DESCRIPTION

Figure 1:
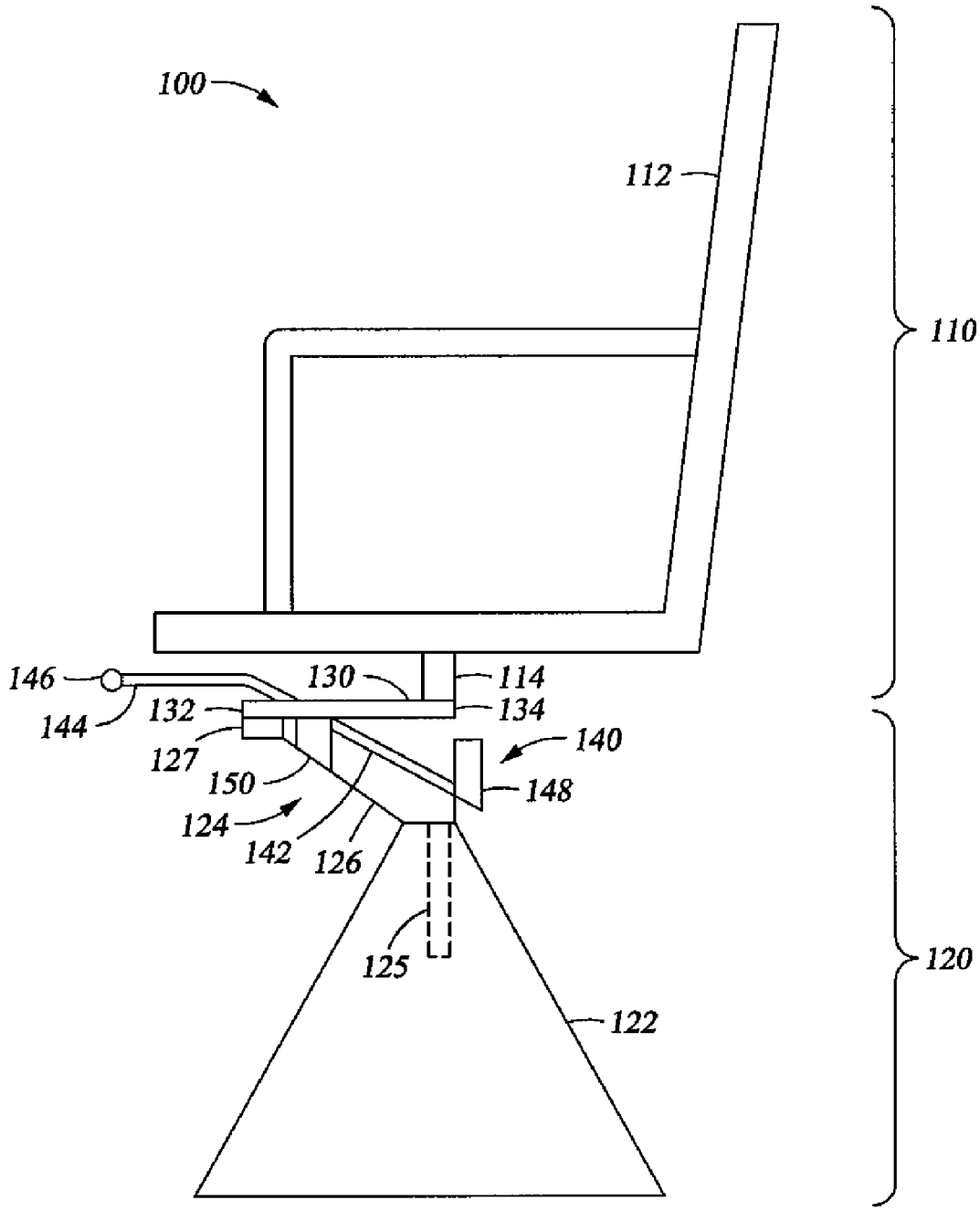
FIG. 1 is a side elevation view of a chair with an embodiment of the Casual Control Tilt Lockout in the unlocked position.

As can be seen in FIGS. 1-6, a chair 100 (serving as the exemplary article of furniture in these figures) incorporating the Casual Control Tilt Lockout generally comprises four components: a frame portion 110, a base portion 120, one or more cantilevers 130, and a locking apparatus 140. In FIG. 1, the frame portion 110 is comprised of a seat 112 and a frame 114. The seat 112 is generally, but not necessarily, padded to cushion and support a person sitting in the chair 100. The frame 114 provides structural support for the seat 112 and connects the seat 112 to the one or more cantilevers 130. The one or more cantilevers 130 allow the frame portion 110 to tilt rearward relative to the base portion 120.

In FIG. 1, the base portion 120 is comprised of a base 122 and a tilter 124. The base 122 supports the chair 100 on the floor and is generally wider at its bottom than the widest portion of the chair 100. Such a configuration helps prevent the chair 100 from being tipped over by a person sitting in the chair 100, thereby improving the stability of the chair 100. In FIG. 1, the tilter 124 comprises a shaft 125, a tilter body 126, and a head 127. The shaft 125 is generally a cylindrical pole extending downward from the tilter body 126 and is shown in phantom line in FIGS. 1 and 2. In FIG. 1, the shaft 125 fits into a hole in the top of the base 122 and may rotate within the base 122 such that the tilter 124, cantilever 130, and frame portion 110 may swivel 360 degrees with respect to the base 122. In FIG. 1, the tilter body 126 extends away from the shaft 125 both horizontally and vertically. Thus, in FIG. 1, the tilter body 126 provides an angled or sloped support, rising up and extending away (forward) from the base 122. The horizontal and vertical aspects of the tilter body 126 allow the frame 114 to be positioned above the tilter body 126 with room to fit a block 148 between the frame 114 and the tilter body 126, a feature that is discussed in greater detail below. The head 127 in FIG. 1 connects the tilter 124 to at least one cantilever 130. Provided that the chair 100 is equipped with a plurality of cantilevers 130, the head 127 may extend outward (sideways) in a horizontal plane away from the tilter body 126 to create adequate separation between the plurality of cantilevers 130 (providing space for the locking apparatus 140), as shown in FIG. 3. Two examples of tilters 124 are U.S. Pat. No. D422, 814 to Sulzer entitled "Casual Chair Control," filed Feb. 11, 1999, and U.S. Pat. D520,780 to Sulzer entitled "Casual Tilter," filed Jul. 1, 2004, both of which are incorporated by reference as if reproduced in their entirety.

The one or more cantilever 130 is the component that allows the frame portion 110 to tilt relative to the base portion 120. Persons of ordinary skill in the art will appreciate that the frame portion 110 can tilt at any angle relative to the horizontal. In specific embodiments, the angle of tilt is 5, 10, 15, 20, 25, 30, 35, 40, 45, 50, 55, 60 degrees or any other angle. While any number of cantilevers 130 may be used in the chair 100, in FIGS. 1, 3, and 5 the chair 100 is configured with two cantilevers 130. In FIG. 1, the cantilevers 130 are bolted, welded, or otherwise connected to the tilter 124 at their proximate end 132 and to the frame 114 at their distal end 134. These connections are generally rigid connections, so that the distal end 134 and the frame 114 move vertically as one, for example. In FIG. 1, the cantilevers 130 are generally rectangular pieces of flat material operable to flex under weight to allow the frame portion 110 to tilt relative to the base portion 120. By attaching the frame 114 to the distal end 134 of the cantilevers 130 (away from the attachment of the cantilevers 130 to the head 127 of the tilter 124), the chair is designed to tilt backward (rearward, towards a reclining position) when sufficient weight is applied to the frame portion 110 (such as by a seated person leaning back in the chair). With reference to the cantilevers 130 of FIG. 1, proximate generally refers to the end 132 facing the direction of the front of the chair, and distal refers generally to the end 134 facing the direction of the back of the chair (although persons of ordinary skill in the art will appreciate that the specific orientation of these terms may be arbitrary and that the terms can be used to describe any two opposite ends of a component).

Although a variety of materials are suitable for making the cantilever, the preferred material for FIG. 1 is metal, specifically, aluminum, iron, or steel. Persons of ordinary skill in the art are able to select the particular grade of material and the material thickness necessary to achieve the desired amount of tilt based on a variety of factors including but not limited to the weight of a person sitting in the chair 100, the weight of the frame portion 110, the desired amount of tilt, the length of the cantilever 130, and the design of the chair. Also, while the front of the chair 100 is generally referred to herein as the proximate end and the rear of the chair 100 is generally referred to as the distal end, persons of ordinary skill in the art will again appreciate that the specific orientation of the terms proximate and distal are arbitrary and can be used to describe any two opposite ends of a component of the chair 100.

The locking apparatus 140 of FIG. 1 is comprised of one or more brackets 150, a body 142, an arm 144, a handle 146, and a block 148. The bracket 150 of FIG. 1 clips or is otherwise fastened onto the tilter 124 and is slidingly engaged to the body 142 of the locking apparatus such that the body 142 can slide forward (in a proximal direction) and backward (in a distal direction) relative to the tilter 124. The bracket 150 of FIG. 1 generally secures the body 142 in place, while also allowing the body 142 to slide (such that the locking apparatus can be moved between its locked and unlocked positions) and optionally providing sufficient frictional resistance to movement of the body 142 to prevent the locking apparatus 140 from unintentionally sliding out of its locked position. The block 148 of FIG. 1 is connected to the distal end of the body 142 and generally prevents the frame portion 110 from tilting relative to the base portion 120 when the locking apparatus 140 is positioned in a locked position (since the block 148 supports the distal end 134 of the cantilever 130, restricting flexing of the cantilever downward). In FIG. 1, the block 148 is a support segment approximately the height of the gap between the tilter body 126 and the unflexed cantilever 130. Thus, when the locking apparatus 140 of FIG. 1 is in its locked position (with the block 148 in a proximal position, wedged between the cantilever 130 and the tilter body 126), the block 148 is generally approximately in line with the frame 114 and the shaft 125 and rigidly supports the distal end 134 of the cantilever 130, restricting the downward flexing that would allow for rearward tilting of the frame portion 110 relative to the base portion 120 of the chair.

In FIG. 1, the arm 144 is connected to the proximate end of the body 142 and extends out from under the seat 112. Preferably, the arm 144 extends out from the front of the seat 112, but persons of ordinary skill in the art will appreciate that the chair 100 may be configured such that the arm 144 extends out one of the sides or the rear of the seat 112. Regardless of its location, the arm 144 of FIG. 1 may optionally be fitted with a handle 146 to facilitate easy user actuation of the locking apparatus 140 between the locked position and an unlocked position. Although not shown in FIGS. 1 and 2, the block 148 may also be configured with at least one pad 149 on its top and/or bottom surfaces. The pad 149 is usually made of a softer material than the material used in the tilter 124 and/or the frame 114, and thus prevents the block 148 from scratching or denting the tilter 124 and/or the frame 114. Optionally, the pad may also be made of a material with a high coefficient of friction, to help secure the block in its locked position. In one specific embodiment, the pad 149 is a polymer material, such as polypropylene, polyester, or polyurethane.

FIGS. 1, 3, 4, 7, and 8 show various views of the locking apparatus 140 in the unlocked position. In the unlocked position, the handle 146 is positioned relatively close to the tilter 124 and may be hidden beneath the seat 112. In addition, the block 148 is positioned away from the proximity of the frame 114 and the tilter 124 when in the unlocked position, such that the block 148 does not impede the tilting motion of the frame portion 110. In other words, in the unlocked position the block 148 does not contact at least one of the cantilever 130 or the tilter body 124, so that the range of motion of the cantilever 130 (flexing downward) is not restricted by the block 148. Thus, when the locking apparatus 140 is in the unlocked position, the person sitting in the chair 100 may lean back or otherwise apply backward or downward pressure on the back of the seat 112 to tilt the frame portion 110 relative to the base portion 120 without the locking apparatus 140 hindering the tilting.

When the person sitting in the chair 100 of FIG. 1 wants to prevent the chair 100 from tilting, the person changes the locking apparatus 140 from the unlocked position to the locked position by actuating the locking apparatus 140 in the forward direction. More specifically, the person pulls the handle 146 forward (in the proximal direction), which moves the arm 144 forward as well. The forward motion of the arm 144 causes the body 142 of the locking apparatus to slide forward through the bracket 150 and pull the block 148 to a position between the frame 114 and the tilter 124. In other words, in the locked position the block 148 of FIG. 1 contacts both the cantilever 130 and the tilter body 124 so that the range of motion of the cantilever 130 is restricted (hindering the ability of the distal end 134 to flex downward). Generally, the person sitting in the chair 100 should not lean back or otherwise apply backward or downward pressure on the back of the seat 112 during this actuating process. In some cases, it may even be necessary for the person sitting in the chair 100 to lean forward or otherwise apply forward or upward pressure on the back of the seat 112 to fully actuate the locking apparatus 140 from the unlocked position.

Figure 2:
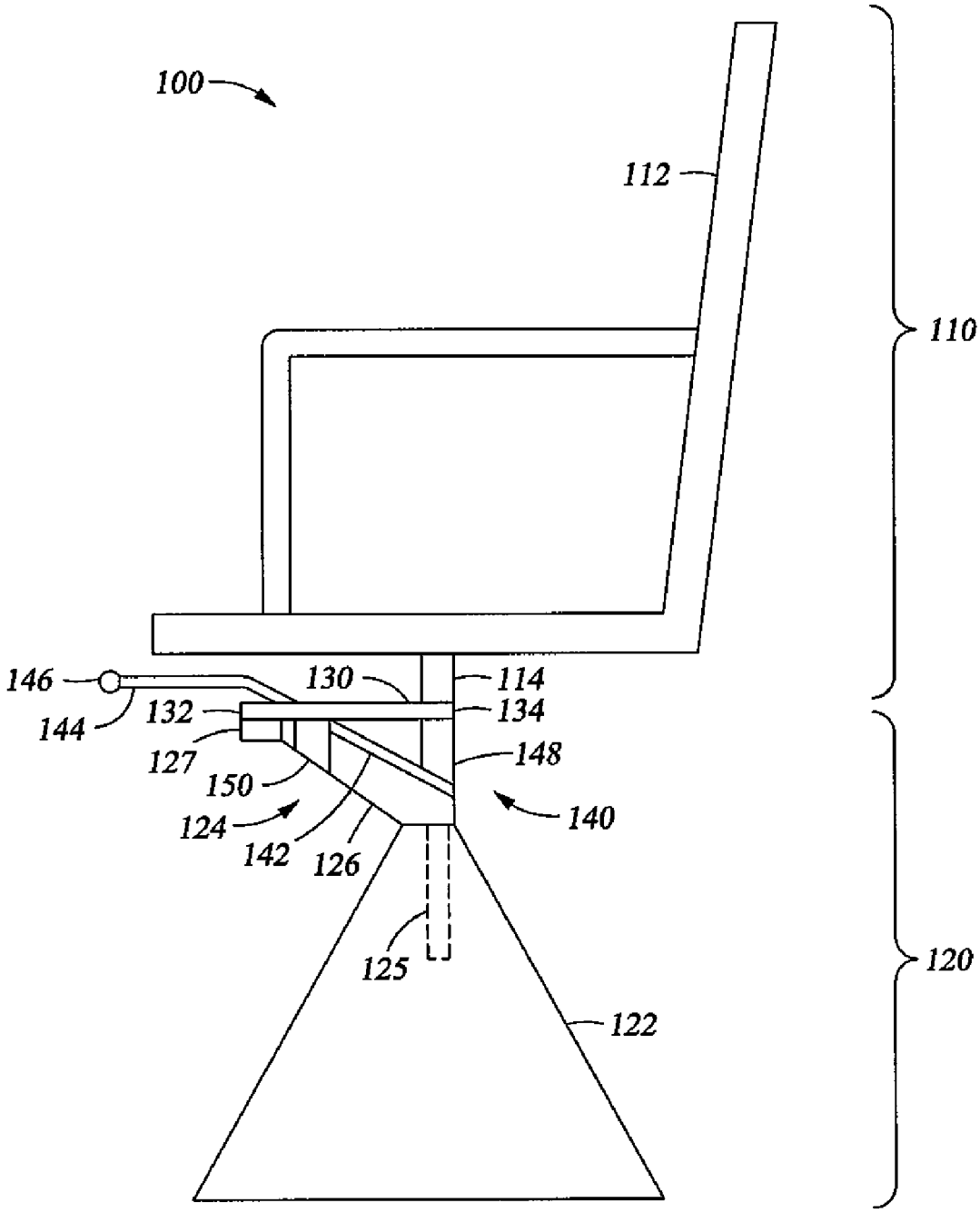
FIG. 2 is a side view of a chair with an embodiment of the Casual Control Tilt Lockout in the locked position.
Figure 3:
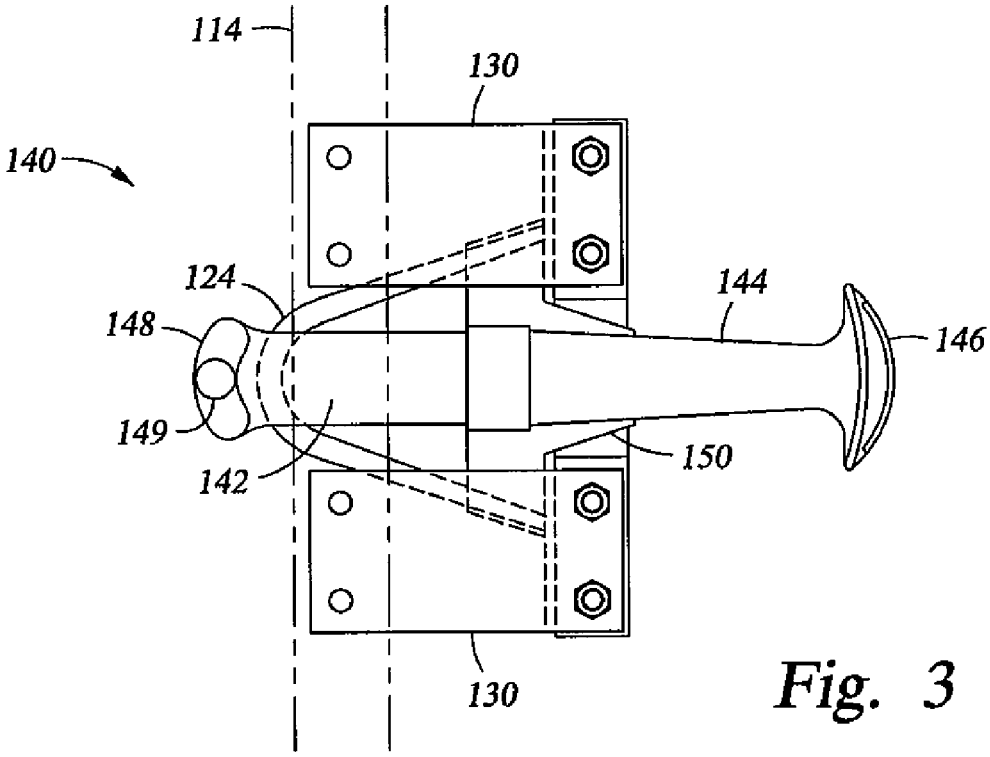
FIG. 3 is a top plan view of an embodiment of the Casual Control Tilt Lockout in the unlocked position.
Figure 4:
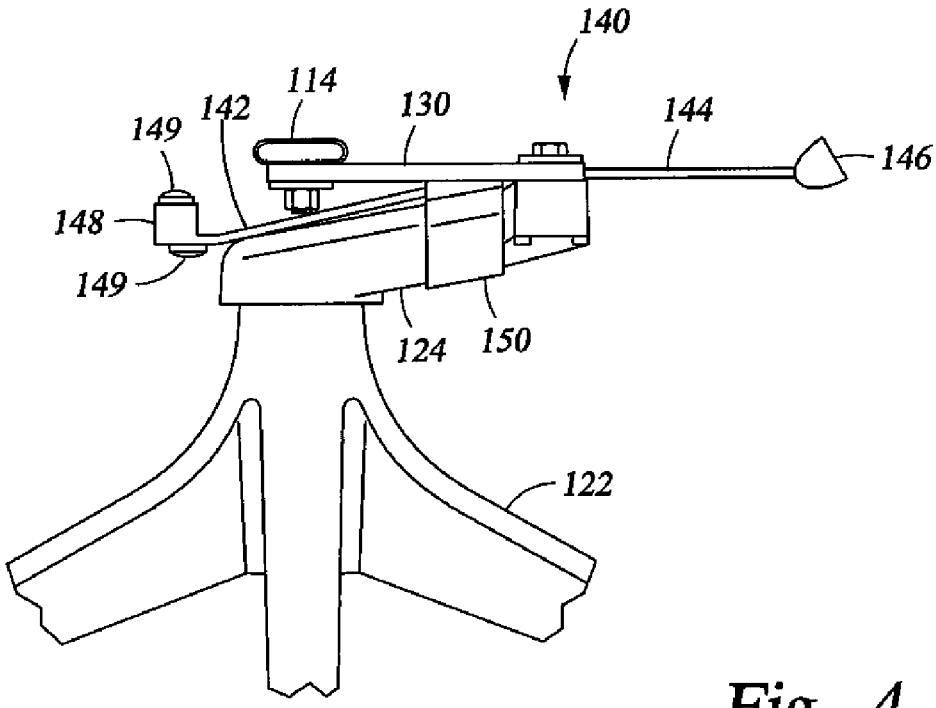
FIG. 4 is a side elevation view of an embodiment of the Casual Control Tilt Lockout in the unlocked position.
Figure 5:
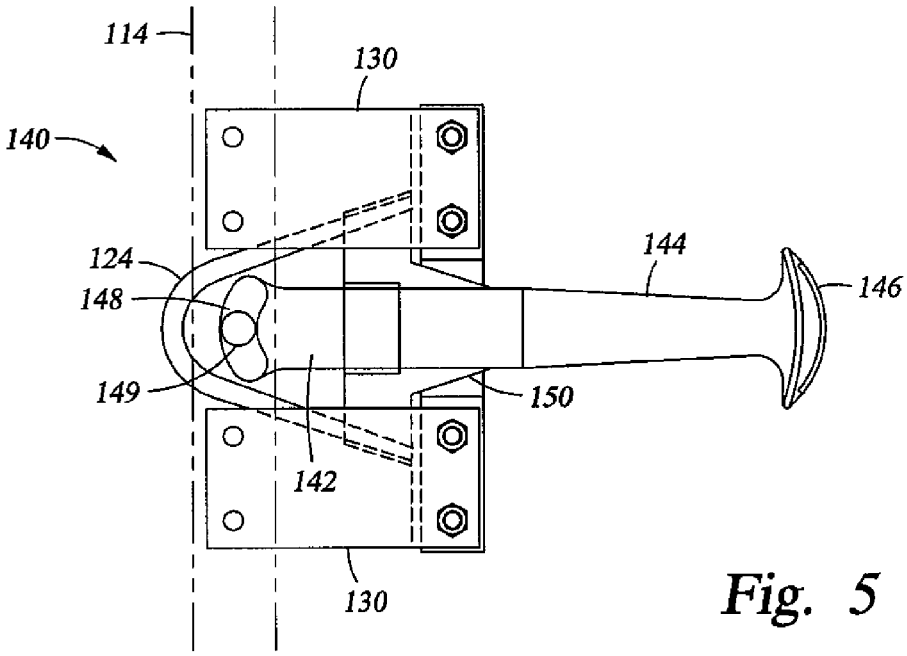
FIG. 5 is a top plan view of an embodiment of the Casual Control Tilt Lockout in the locked position.
Figure 6:
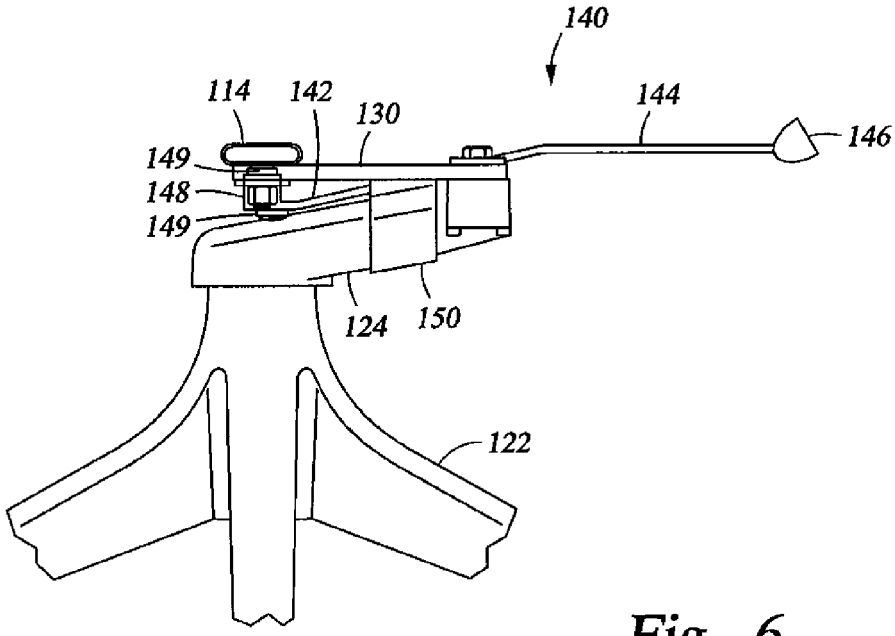
FIG. 6 is a side elevation view of an embodiment of the Casual Control Tilt Lockout in the locked position.
Figure 7:
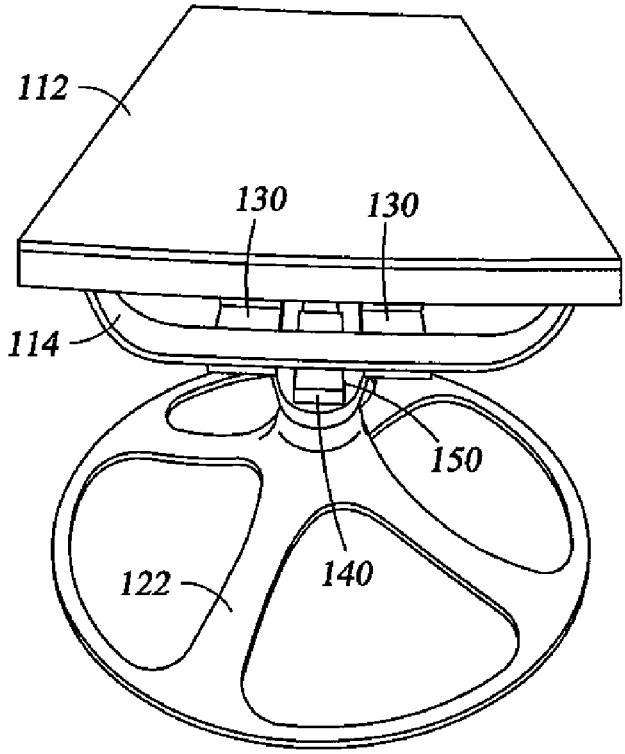
FIG. 7 is an upper rear perspective view of an embodiment of the Casual Control Tilt Lockout in the unlocked position.
Figure 8:
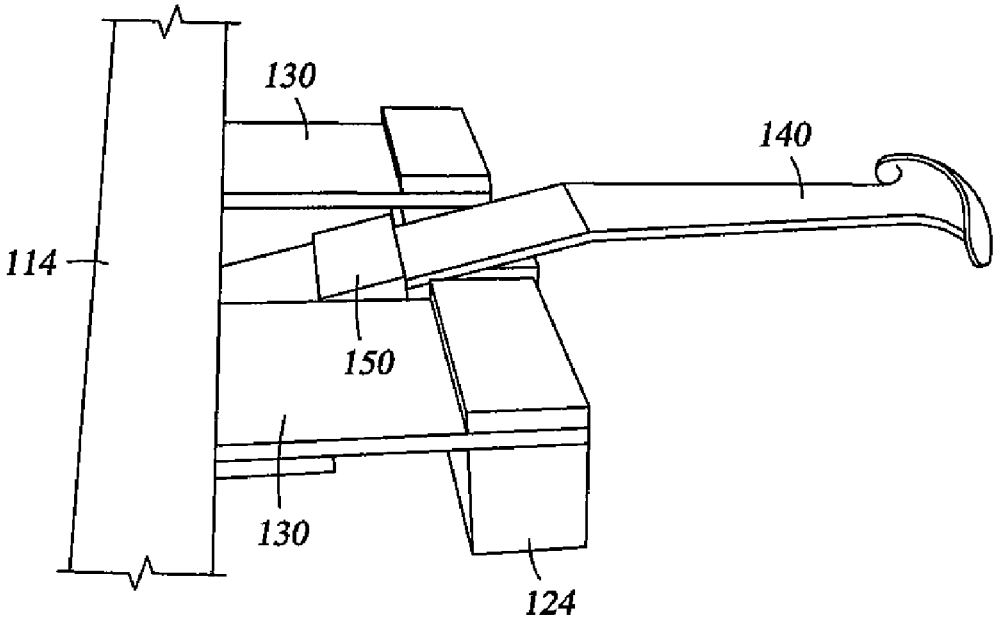
FIG. 8 is an upper side perspective view of an embodiment of the Casual Control Tilt Lockout in the unlocked position.
Figure 9:
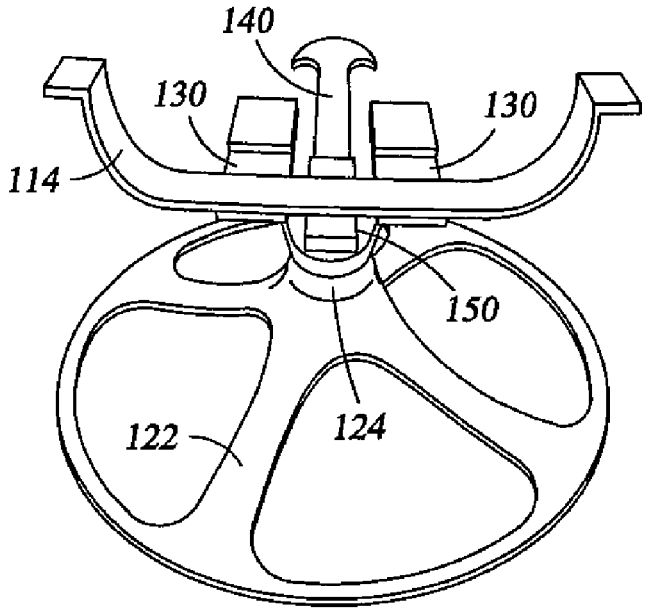
FIG. 9 is an upper rear perspective view of an embodiment of the Casual Control Tilt Lockout in the locked position.
Figure 10:
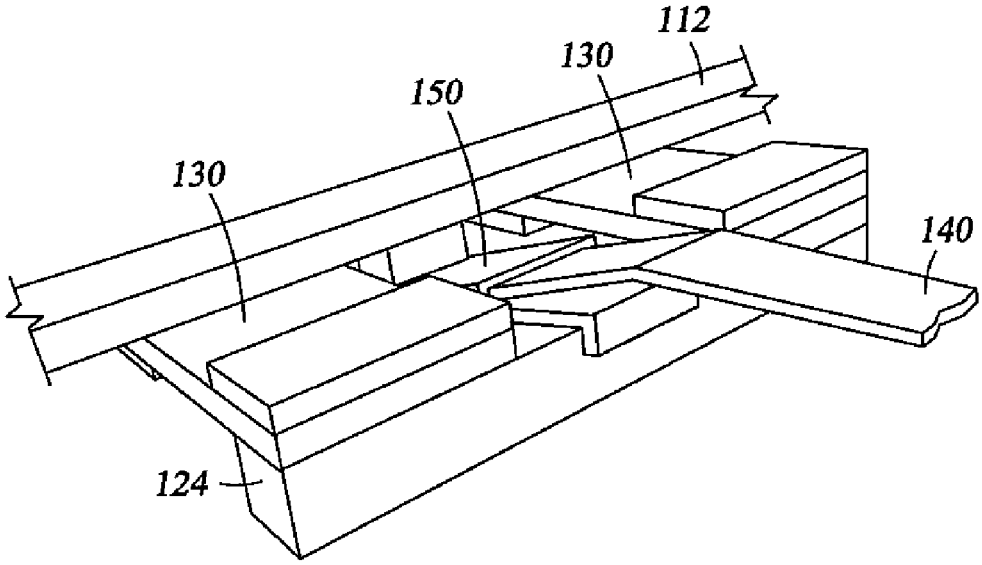
FIG. 10 is an upper angled perspective view of an embodiment of the Casual Control Tilt Lockout in the locked position.

FIGS. 2, 5, 6, 9, and 10 show various views of the locking apparatus 140 in the locked position. In the locked position, the handle 146 is positioned relatively far away from the tilter 124 and generally sticks out from under the chair 100 (as seen in FIG. 6). In addition, in the locked position the block 148 of FIG. 2 is positioned between the frame 114 and the tilter 124 such that the block 148 restricts flexing of the cantilever 130 by fixing the distal end 134 of the cantilever vertically with respect to the base portion so that the distal end 134 cannot flex downward. Thus in its locked position, the locking apparatus 140 limits the frame portion 110 from tilting (backward) relative to the base portion 120 even when the person sitting in the chair 100 may lean back or otherwise apply backward or downward pressure on the back of the seat 112.

When the person sitting in the chair 100 wants to tilt the chair 100, the person changes the locking apparatus 140 from the locked position to the unlocked position by actuating the locking apparatus 140 in the rearward direction in FIG. 1. More specifically, the person pushes the handle 146 rearward (distally), which moves the arm 144 rearward as well. The rearward motion of the arm 144 causes the body 142 to slide rearward through the bracket 150 and push the block 148 out away from between the frame 114 and the tilter 124. Generally, the person sitting in the chair 100 should not lean back or otherwise apply backward or downward pressure on the back of the seat 112 during this actuating process. In some cases, it may even be necessary for the person sitting in the chair 100 to lean forward or otherwise apply forward or upward pressure on the back of the seat 112 to begin actuating the locking apparatus 140 towards the unlocked position.

Figure 11:
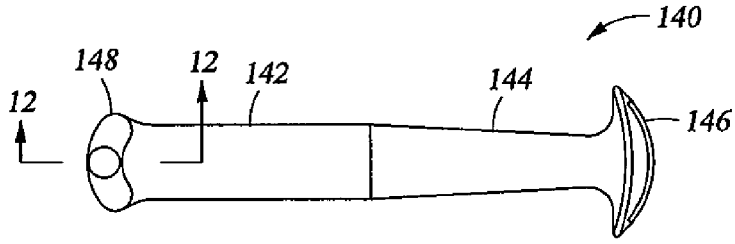
FIG. 11 is a top plan view of an embodiment of the locking apparatus of the Casual Control Tilt Lockout.
Figure 12:
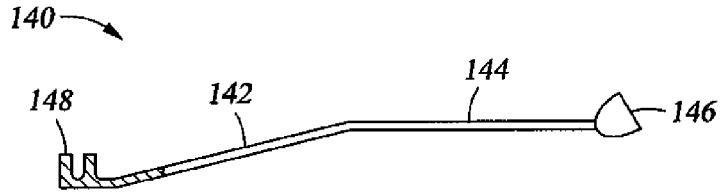
FIG. 12 is a side and partial cross-sectional view of an embodiment of the locking apparatus of the Casual Control Tilt Lockout taken along line 12-12 in FIG. 11.

FIGS. 11-15 show the locking apparatus 140 in greater detail. FIGS. 11 and 12 illustrate the block 148, the body 142, the arm 144, and the handle 146 of the locking apparatus 140. The block 148 is located on the rearward (distal) side of the body 142 and may contain a hole (not shown) to allow the pad 149 (shown in FIGS. 3-6) to be inserted into the block 148. The body 142 may be angled with respect to the horizontal such that it is substantially parallel to the surface of the tilter 124 when the locking apparatus 140 is installed on the base portion 120. Such a configuration improves the aesthetic appearance of the chair 100 by minimizing the appearance of the locking apparatus 140. In addition, the arm 144 may be substantially horizontal such that it does not contact the seat 112 when the person actuates the arm 144 between the locked position and the unlocked position. The handle 146 is attached to the end of the arm 144 and may be angled upwards to improve the ergonomics and/or operability of the locking apparatus 140. If desired, a decorative logo or instructions for actuating the locking apparatus 140 may be imprinted or otherwise placed on the front surface of the handle 146. Optionally, the handle may be padded to improve ergonomics.

Figure 13:
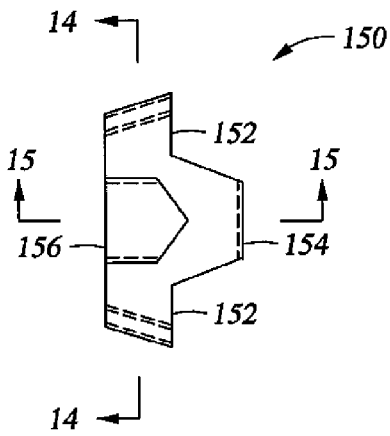
FIG. 13 is a top plan view of an embodiment of the bracket of the Casual Control Tilt Lockout.
Figure 14:
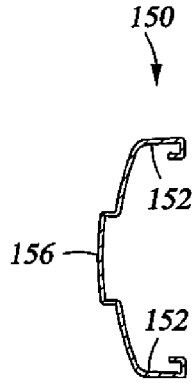
FIG. 14 is a cross-sectional view of an embodiment of the bracket of the Casual Control Tilt Lockout taken along line 14-14 in FIG. 13.
Figure 15:
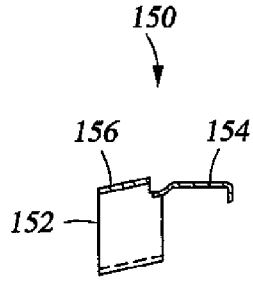
FIG. 15 is a cross-sectional view of an embodiment of the bracket of the Casual Control Tilt Lockout taken along line 15-15 in FIG. 13.
Figure 16:
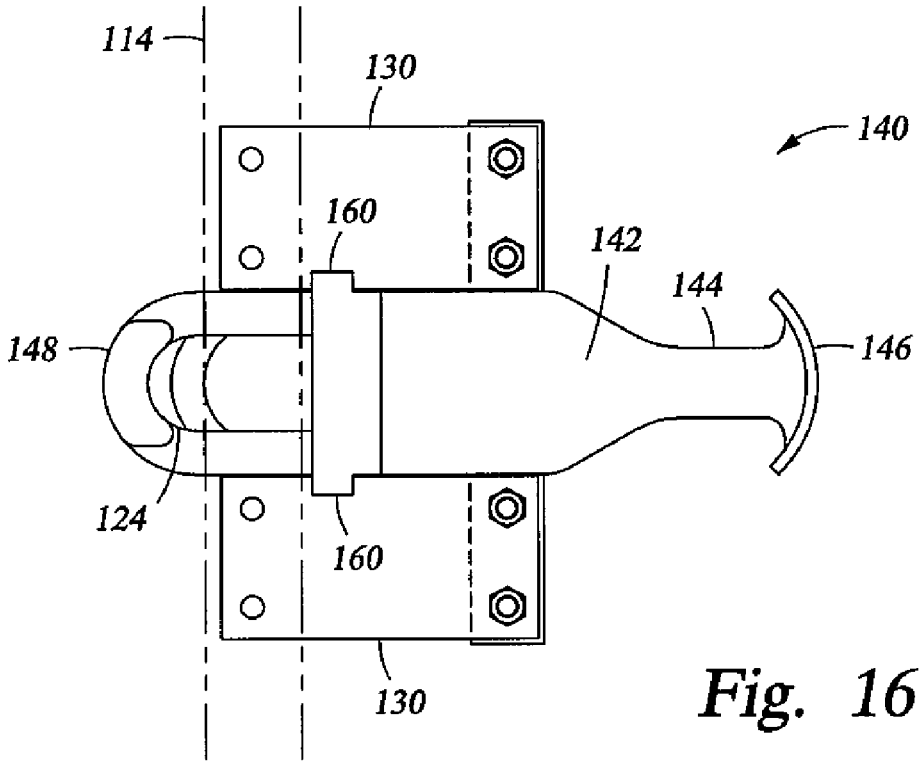
FIG. 16 is a top plan view of an alternative embodiment of the Casual Control Tilt Lockout in the unlocked position.
Figure 17:
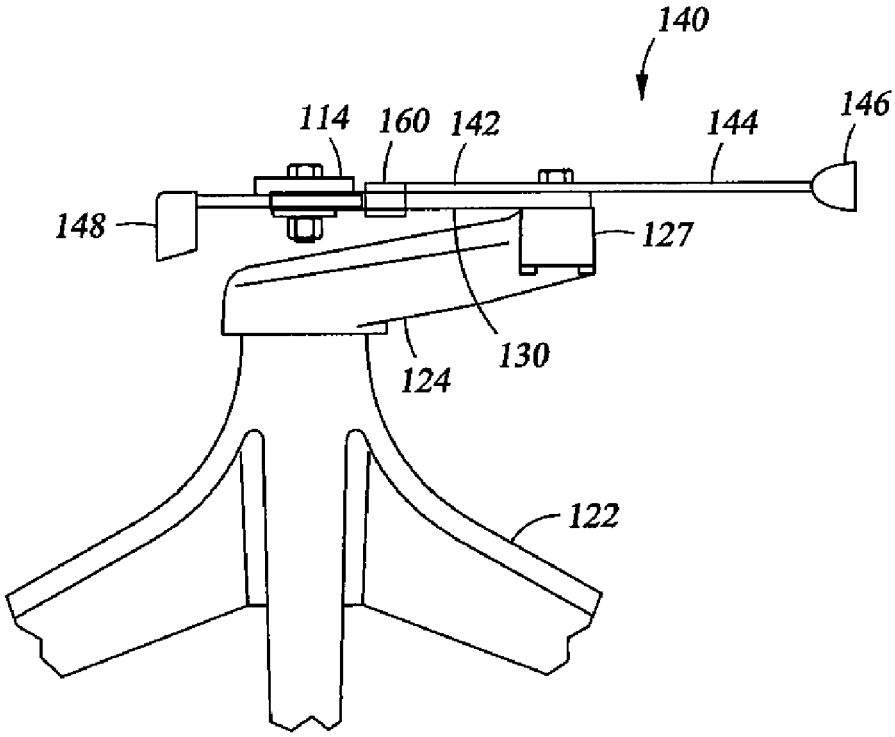
FIG. 17 is a side elevation view of the alternative embodiment of the Casual Control Tilt Lockout in the unlocked position.
Figure 18:
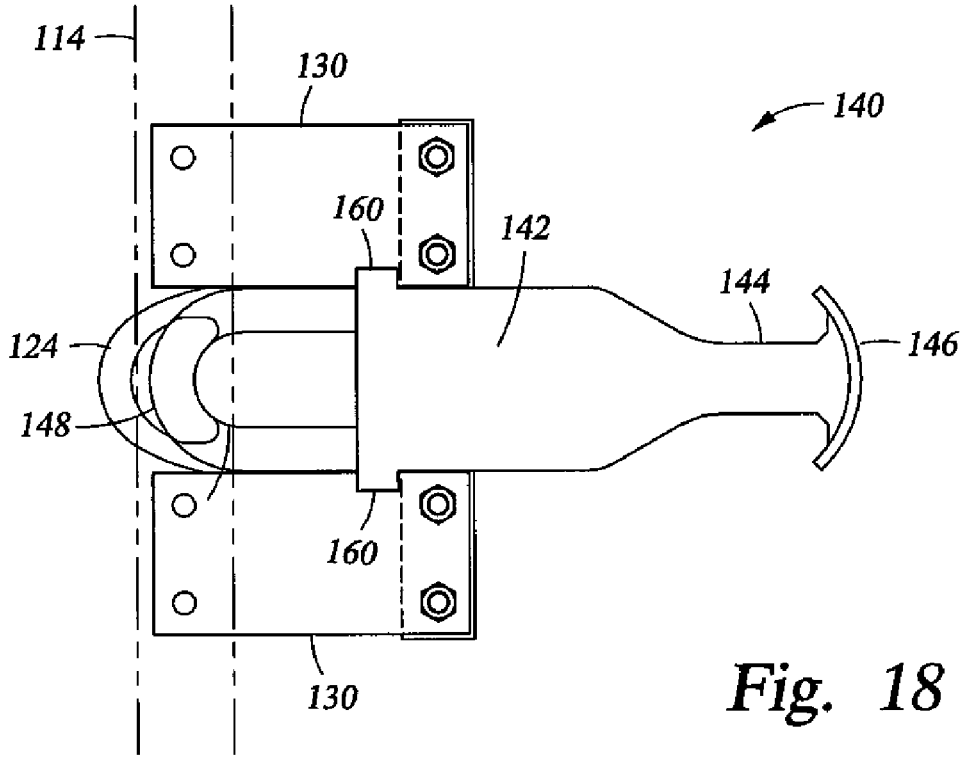
FIG. 18 is a top plan view of the alternative embodiment of the Casual Control Tilt Lockout in the locked position.
Figure 19:
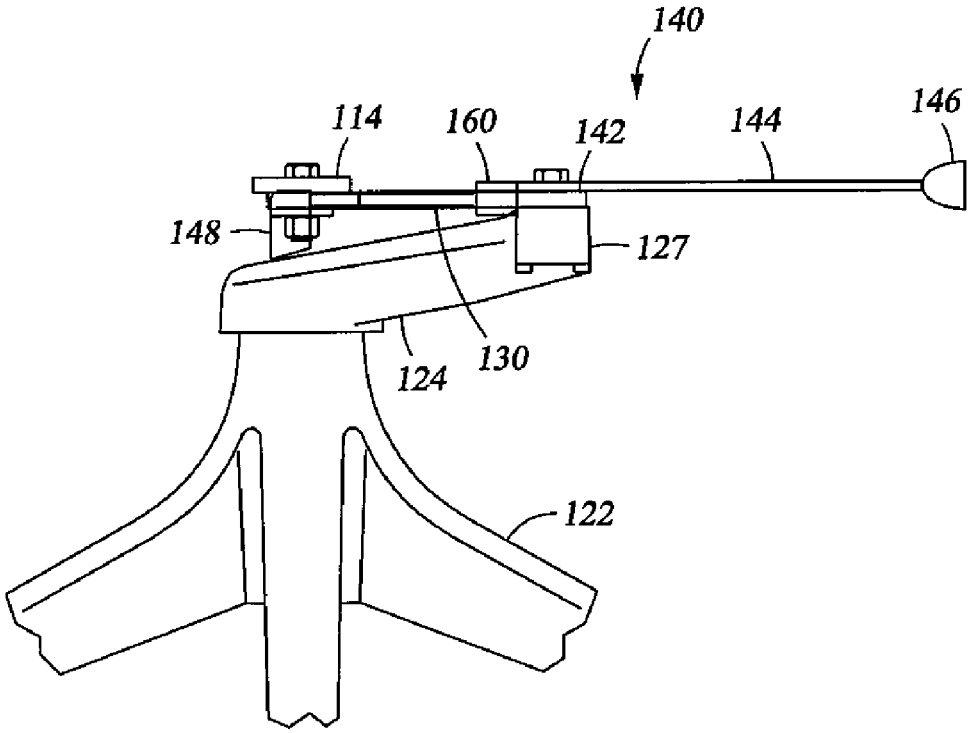
FIG. 19 is a side elevation view of the alternative embodiment of the Casual Control Tilt Lockout in the locked position.
Figure 20:
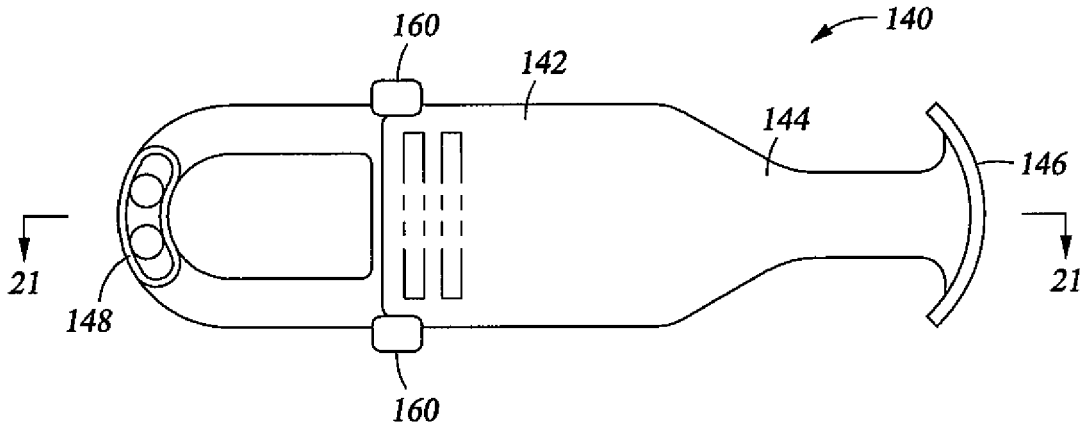
FIG. 20 is a top plan view of the alternative embodiment of the locking apparatus of the Casual Control Tilt Lockout.
Figure 21:
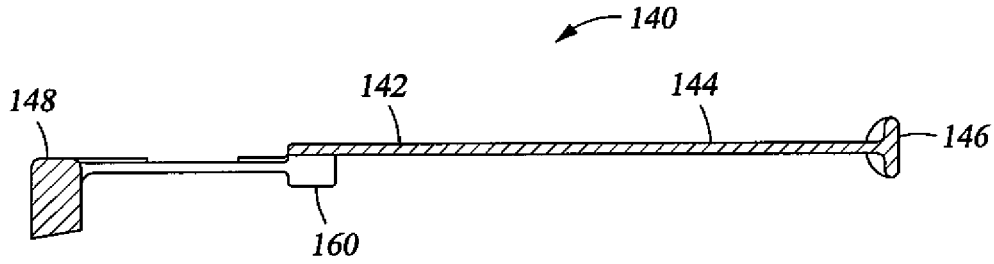
FIG. 21 is a cross-sectional view of the alternative embodiment of the locking apparatus of the Casual Control Tilt Lockout taken along line 21-21 in FIG. 21.

FIGS. 13-15 illustrate the bracket 150 of the locking apparatus 140. The bracket 150 in these figures connects the remainder of the locking apparatus 140 to the tilter 124 and comprises a plurality of clips 152, a lower guide 154, and an upper guide 156. The clips 152 are configured to wrap around the sides and underneath the tilter 124, thereby securing the bracket 150 to the tilter 124. Persons of ordinary skill in the art will appreciate that the bracket 150 does not necessarily have to clip to the tilter 124. Rather, the bracket 150 may be connected to the frame portion 110, the base portion 120, the cantilever 130, or a combination of the three using any suitable attachment means, such as screws, bolts, welds, and/or an adhesive. In FIGS. 13-15, the lower guide 154 is configured to conform to the upper surface of the tilter 124 and is positioned beneath the body 142 such that it acts as a lower support for the body 142. In such an embodiment, the body 142 slides across at least a portion of the upper surface of the lower guide 154. The upper guide 156 acts as a guide for the upper surface of the body 142 such that the body 142 is positioned below at least a portion of the upper guide 156. And in such an embodiment, the body 142 slides through the bracket 150 by sliding across at least a portion of the lower surface of the upper guide 156. If desired, the bracket 150 may be configured with additional lower guides 154 or upper guides 156. Thus, the bracket 150 of these figures may serve to slidably secure the locking apparatus 140 in place both vertically and horizontally, enabling the body 142 to slide from locked to unlocked positions.

Figure 22:
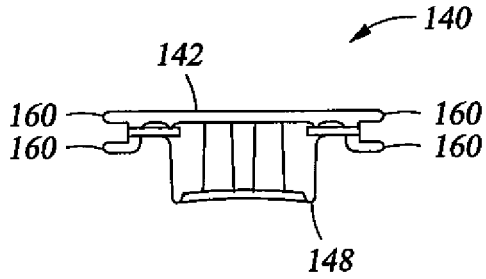
FIG. 22 is a rear elevation view of the alternative embodiment of the locking apparatus of the Casual Control Tilt Lockout.

FIGS. 16-22 illustrate an alternative embodiment of the Casual Control Tilt Lockout. The alternative embodiment of the locking apparatus 140 is similar to the previous embodiment of the locking apparatus 140, with the exception that the alternative embodiment of the locking apparatus 140 contains a plurality of fingers 160 in lieu of the bracket 150. As can be seen in FIG. 22, the fingers 160 are positioned on both sides of the body 142 as well as on the top surface and the bottom surface of the body 142. If desired, the locking apparatus 140 may be configured with more fingers 160 than shown in the figures. When the locking apparatus 140 is installed on the chair 100, the fingers 160 extend above and below each of the cantilevers 130 and keep the locking apparatus 140 positioned between the cantilevers 130. The fingers 160 also allow the locking apparatus 140 to slide forward and backward along the cantilevers 130. The travel of the locking apparatus 140 along the cantilevers 130 may be limited in the forward direction by the head 127 of the tilter 124 and limited in the rearward direction by the frame 114. Preferably, the alternative embodiment of the locking apparatus 140 is configured such that the locking apparatus 140 is in the locked position when the fingers 160 contact the head 127 and in the unlocked position when the fingers 160 contact the frame 114. However, a person of ordinary skill in the art will appreciate that the alternative embodiment of the locking apparatus 140 can be configured such that the locking apparatus 140 is in the unlocked position when the fingers 160 contact the head 127 and in the locked position when the fingers 160 contact the frame 114.

The various components illustrated and discussed herein can be made of any type of material and produced by any acceptable method. For example, the various components may be made of wood, metal, plastic, other materials, or combinations thereof. The components may be made by milling, casting, forging, extrusion, any other manufacturing method, or combinations thereof. In one embodiment, the components are aluminum and made in a die casting process. One method for die casting aluminum components is described in U.S. Pat. No. 7,772,821 to Fulton et al., entitled "System for Manufacturing Die Castings," which is incorporated by reference as if reproduced in its entirety. And while the locking apparatus embodiments generally described herein provide a single forward locked position, the invention is not so limited. Rather, the locking apparatus may provide a lock position at various tilts (preventing further backward tilting past a given locked position), or it may allow for a variety of locked positions based on positioning of the locking apparatus. By way of non-exclusive example, the block could be an angled wedge or a series of extension supports of various heights (stepped from lowest in the proximal direction to highest in the distal direction), so that depending on the position of the arm (and thus the height of the support block element contacting the cantilever), the chair could be locked into a plurality of positions.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Accordingly, the scope of protection is not limited by the description set out above, but is defined by the claims which follow, that scope including all equivalents of the subject matter of the claims. Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings refer to a "Field of the Invention," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

What is claimed is:

1. An apparatus comprising:

a cantilever having a distal end and a proximate end;

a frame portion coupled to the distal end, the frame supporting a seat;

a base portion coupled to the proximate end; and a locking apparatus coupled to the frame portion, the base portion, or the cantilever;

wherein the cantilever is flexible such that the frame portion is operable to tilt relative to the base portion;

wherein the locking apparatus has a locked position and an unlocked position;

wherein the locking apparatus restricts tilting of the frame portion relative to the base portion when the locking apparatus is in the locked position;

wherein the locking apparatus comprises:

a body having a proximate end and a distal end;

an arm rigidly affixed to the proximate end; and a block rigidly affixed to the distal end; and wherein the locking apparatus is actuated into the locked position when the arm is pulled forward, thereby sliding the block into position between the frame portion and the base portion; and wherein the cantilever comprises a top surface and a bottom surface, and the locking apparatus further comprises: a plurality of fingers that extend from the body to at least partially wrap around the top and bottom surfaces of the cantilever to slidingly attach the body to the cantilever.

2. The apparatus of claim 1 wherein in the locked position the block supports the distal end of the cantilever.

3. The apparatus of claim 1 wherein in the locked position the block restricts downward flexing of the cantilever.

4. The apparatus of claim 1 wherein in the locked position the block contacts the cantilever and the base portion.

5. The apparatus of claim 1 wherein the locking apparatus is actuated into the locked position when the arm is pulled forward, causing the body to slide forward along the cantilever and pulling the block at least horizontally into position between the cantilever and the base portion.

6. A chair comprising:

a base;

a tilter coupled to the base such that the tilter rotates relative to the base;

a cantilever having a proximate end coupled to the tilter and a distal end;

a frame coupled to the distal end, the frame supporting a seat such that the seat is only attached to the cantilever at the distal end; and a locking apparatus having a locked position and an unlocked position and coupled to the tilter, the cantilever, or the frame;

wherein the tilter extends away from the base both horizontally and vertically to provide an angled support surface;

wherein the locking apparatus comprises:

a body having a proximate end and a distal end;

an arm affixed to the proximate end and extending substantially horizontally; and a block affixed to the distal end;

wherein the cantilever is flexible such that the seat is operable to tilt relative to the base; and wherein the cantilever comprises a top surface and a bottom surface, and the locking apparatus further comprises: a plurality of fingers that extend from the body to at least partially wrap around the top and bottom surfaces of the cantilever to slidingly attach the body to the cantilever.

7. The chair of claim 6:

wherein the seat is operable to tilt relative to the base;

wherein the locking apparatus prevents the seat from tilting relative to the base when the locking apparatus is in the locked position; and wherein the seat is free to tilt relative to the base when the locking apparatus is in the unlocked position.

8. The chair of claim 6 wherein the arm, body, and block are rigidly joined into an integrated whole, and the locking apparatus is actuated into the locked position by pulling the arm forward, causing the body to slide forward along the cantilever and pulling the block at least horizontally into the locked position.

9. The chair of claim 6, wherein the arm, body, and block are rigidly joined into an integrated whole.

* * * * *